United States Patent [19]

Glassman

[11] 4,312,338

[45] Jan. 26, 1982

[54] SURGICAL MASK

[76] Inventor: Jacob A. Glassman, 1680 Michigan Ave., Miami Beach, Fla. 33139

[21] Appl. No.: 113,578

[22] Filed: Jan. 21, 1980

[51] Int. Cl.[3] ..... A61F 9/04

[52] U.S. Cl. ..... 128/201.12; 128/206.19

[58] Field of Search ..... 128/201.12, 201.14, 128/201.15, 206.19

[56] References Cited

U.S. PATENT DOCUMENTS

| | | | |
|---|---|---|---|
| 2,905,172 | 9/1959 | Rodenhouse | 128/201.12 |
| 2,951,418 | 9/1960 | Bitner et al. | 128/201.12 X |
| 3,146,295 | 8/1964 | Roland | 128/201.12 X |
| 3,563,640 | 2/1971 | Wise et al. | 128/201.12 X |
| 3,603,315 | 9/1971 | Becker | 128/206.19 |
| 3,747,599 | 7/1973 | Malmin | 128/201.12 |
| 4,057,057 | 11/1977 | Backlund | 128/201.12 |
| 4,105,026 | 8/1978 | Hay | 128/201.12 |

FOREIGN PATENT DOCUMENTS

| | | | |
|---|---|---|---|
| 2029461 | 12/1971 | Fed. Rep. of Germany | 128/201.12 |

*Primary Examiner*—Henry J. Recla
*Attorney, Agent, or Firm*—Elmer L. Zwickel

[57] ABSTRACT

A surgical mask, or other face covering, including a structure effective to prevent a pair of spectacles from sliding down along the nose of the wearer.

8 Claims, 9 Drawing Figures

SURGICAL MASK

The invention relates to improvements in surgical masks and is particularly concerned with the provision of novel means, integral with the mask, to engage with and support a pair of spectacles in position on the nose of the wearer. More particularly, the improvement comprises the provision of a novel stay or the like, fabricated from pliable shape-retaining material, on or within a surgical mask and which is adapted to be manipulated at will so as to contact a pair of spectacles and maintain them in a predetermined position on the nose of the wearer. Specifically, the stay is intended to prevent a pair of spectacles from sliding down on the nose of the wearer during the performance of surgery. Such downward sliding often occures while the wearer's hands are occupied with a task and frequently terminates in the spectacles falling off the wearer's face and dropping into the surgical field. To a lesser degree, such sliding may carry the spectacles out of focus to the detriment of the patient and chagrin of the surgeon.

The within disclosure of a surgical mask equipped with a spectacle support involves the provision, along the upper margin of the mask, of a pliable shape-retaining member that reinforces said margin and embodies means to contact and/or grip a pair of spectacles in the area of the nose bridge. The retaining member may be enclosed within the material of the mask or it may be wholly or partially exposed.

Such a mask, when worn, may have it's spectacle engaging member manipulated readily into engagement with the spectacles after they are properly positioned on the wearer's nose. The manner of spectacle retention affords means whereby the spectacles can be retained in any specific position on the nose.

Objects of the invention are to provide a surgical mask with novel means to support a pair of spectacles on the nose of the wearer; to provide a surgical mask with a readily deformable shape-retaining spectacle support; to provide low cost means for retaining spectacles in place on the nose of the wearer; and to provide generally a surgical mask with inherent means to support a pair of spectacles in a selected position on the nose of the wearer.

Other advantages and objects of the invention will become apparent with reference to the following description and accompanying drawing:

Figure 9:
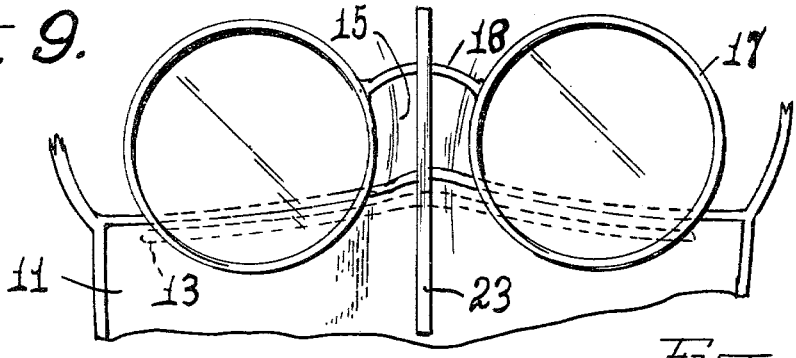
Figure 8:
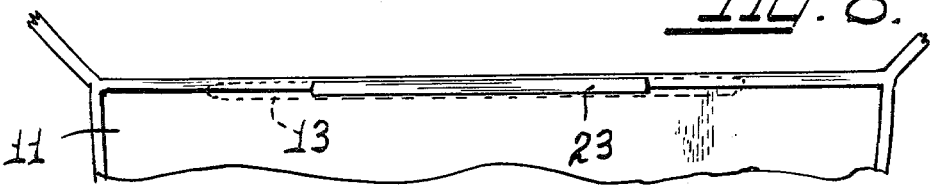

FIG. 8 discloses a mask having an adhesive tape substituted for the pliable shape-retaining extension, and FIG. 9 is a view showing the mask of FIG. 8 in place and the adhesive tape holding the spectacles in position.

Figure 1:
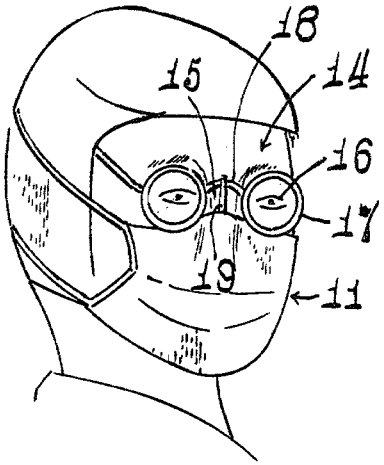
FIG. 1 is a perspective view of the mask while in position on the face of the wearer.
Figure 4:
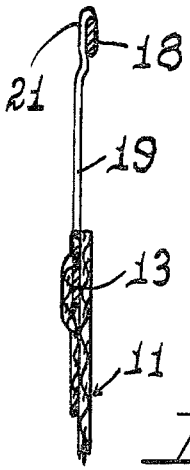
FIG. 4 is a detail sectional view taken on line 4—4 of FIG. 3.
Figure 2:
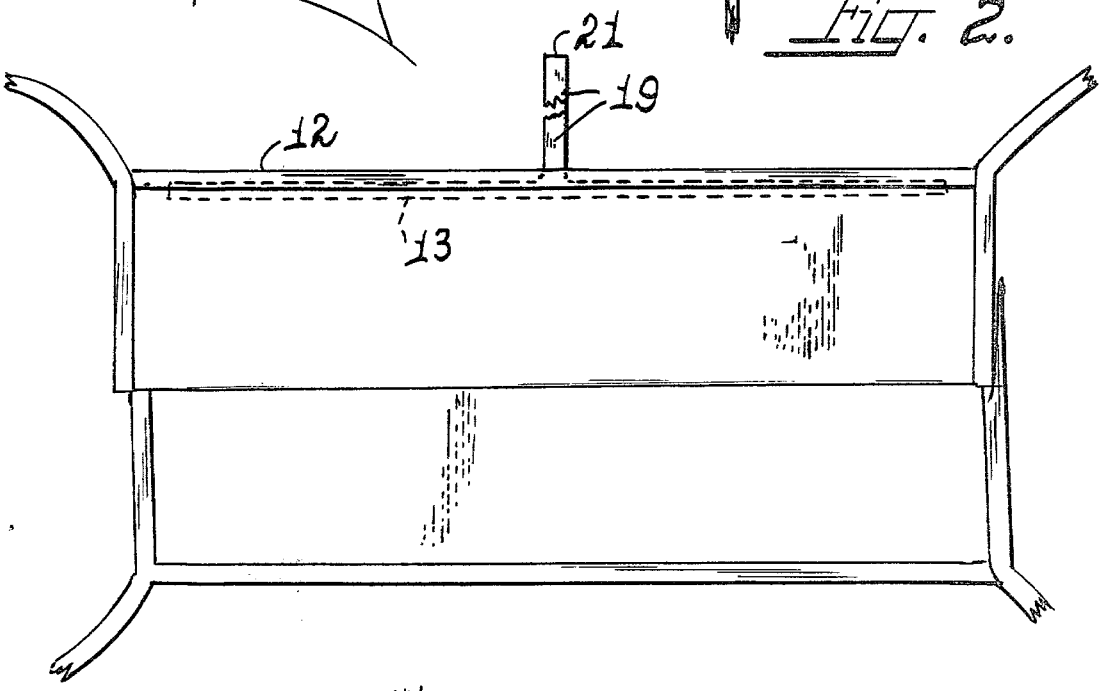
FIG. 2 is a front elevational view of a representative mask embodying the improvement.

Referring to the representative disclosure of the invention in the accompanying drawings wherein like numbers are used to identify similar parts; and particularly to FIGS. 1 and 4; there is depicted a surgical mask 11 which may be of any known or conventional construction, or specially constructed, having an upper edge 12 upon, adjacent to, or within which is mounted a reinforcing strip 13 of pliable shape-retaining material, such as plastic or lead alloy. When the mask is mounted over the face 14 of a surgeon, or other technician, to lie across the wearer's nose, 15, the upper edge 12 (FIG. 2) lies just below the eyes 16. The wearer's spectacles 17, include a bridge 18 that lies across the nose. The position of the bridge along the length of the nose depends upon the wishes of the wearer.

Figure 3:
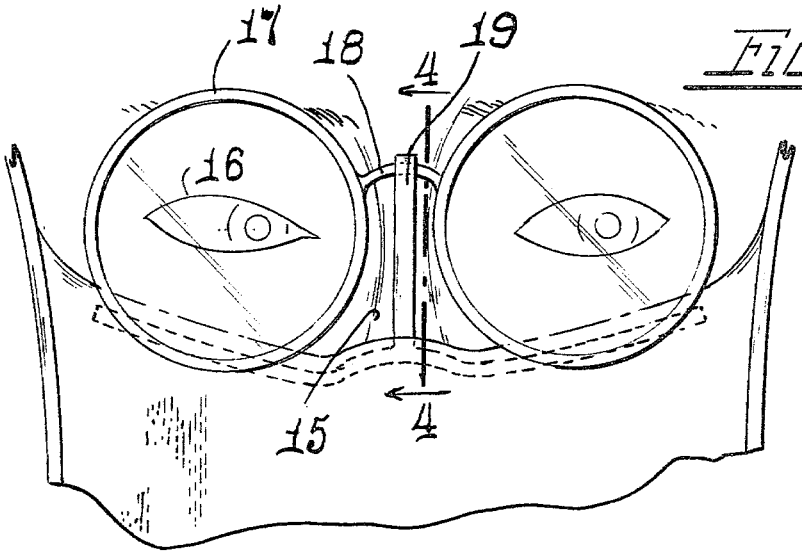
FIG. 3 is a full front view of a mask partially broken away, on the face of a wearer.

Some wearers push the spectacles up on the nose as far as possible, whereas other wearers locate the bridge near the tip of the nose. In either event, means is provided on the strip 13 to prevent or restrain the spectacles from falling off the wearer's nose. As best shown in FIGS. 3 and 4, the strip 13 has a perpendicular extension 19 that is manipulated to bring it's free end 21 into contact with the bridge 18. This engagement can be mere contact or, if desired, the free end 21 of the extension may be crimped or wrapped around the nose bridge, as exemplified in FIG. 4.

Figure 5:
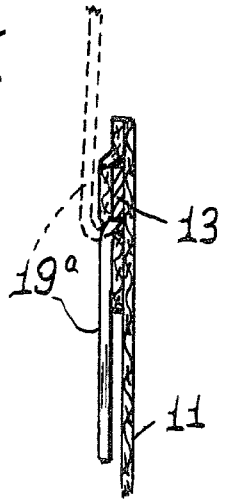
FIG. 5 is a view similar to FIG. 4, showing a modified structure.

FIG. 5 is illustrative of a structure wherein the extension 19*a* is projected downwardly when not in use, but which is bent upwardly to overlie and engage the bridge of the spectacles after the mask is arranged over the face.

Figure 6:
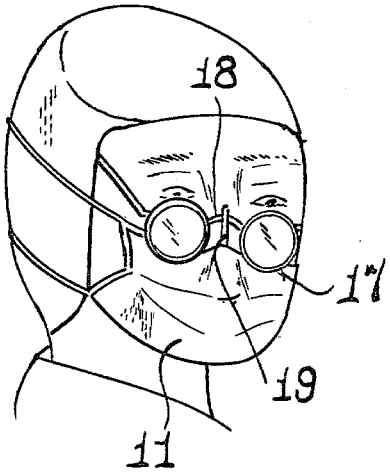
FIG. 6 is a view similar to FIG. 1, illustrating the location of the spectacles close to the tip of the nose.

In FIG. 6, the wearer of the spectacles 17 has preferred to wear them close to the tip of the nose. In this instance, the pliable extension 19 is adjusted in such manner as to cooperate with the bridge 18 of the spectacles 17 for holding it firmly in place.

Figure 7:
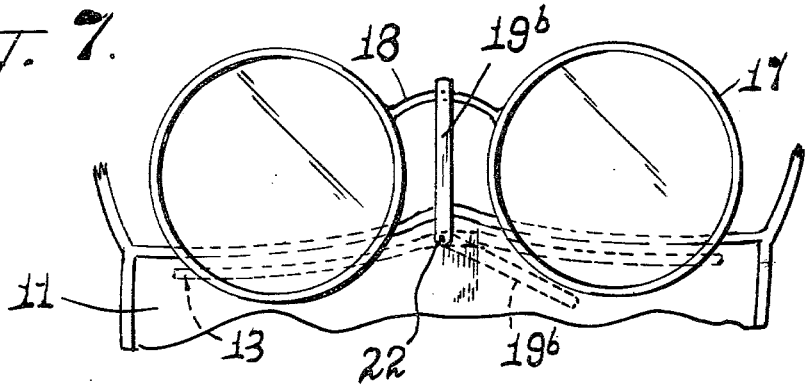
FIG. 7 is similar to FIG. 3 but showing a pivoted extention.

The mask 11, illustrated in FIG. 7, is substantially like those described previously, but here the extension 19*b* is a separate element pivotally secured, as at 22, to the pliable strip 13. Thus the extension 19*b* can be adjusted to lie substantially parallel to the strip, as shown in dotted lines, or be pivotally moved into a position substantially perpendicular to said strip, as shown in full lines in said figure.

FIGS. 8 and 9 are representative of a mask structure that has no extension 19 but instead, a length of flexible shape-retaining material 23, such as a fabric tape, having a layer of pressure sensitive adhesive on one face thereof, is normally adhesively secured to the strip 13 or the material covering said strip. When use of the length 23 is required, it is peeled from the mask, and arranged perpendicular, as shown in FIG. 9, so as to over-lie and be adhesively secured to the mask 11, the spectacle bridge 18 and the nose 15.

Although I have described various embodiments of my invention, in considerable detail, it will be understood that the description thereof is intended to be illustrative rather than restrictive, as details of the structures may be modified or changed without departing from the spirit or scope of the invention. Accordingly, I do not desire to be restricted to the exact construction shown and described.

I claim:

1. A surgical mask adapted to cover part of the nose, the mouth and the chin of a person wearing spectacles having a nose-bridge, said mask having an upper edge adapted to be located below said nose-bridge, spectacle support means normally attached to the outside surface of the mask adjacent said upper edge, said support means comprising a strip of flexible shape-retaining material having adhesive means removably and adhesively securing said strip to the mask, said adhesive means adapting said strip to be removed from the mask when in use and be resecured in a vertical position to overly the mask, nose-bridge and nose of the person for retaining the spectacles against displacement on the nose.

2. The surgical mask recited in claim 1, in which said means comprises a removable adhesively coated tape on the mask that is repositionable and adhesively secured at one end to the mask and at the other end to the nose-bridge and nose.

3. The surgical mask recited in claim 2, in which the adhesively coated tape is carried on the outside surface of the mask prior to use.

4. A surgical mask adapted to cover part of the nose, the mouth and the chin of a person wearing spectacles having a nose-bridge, said mask having an upper edge adapted to be located below said nose-bridge, and spectacle support means attached to the mask adjacent said upper edge and adapted to extend upwardly and against the front of the nose-bridge when said mask is in use for retaining the spectacles in a selected position on the nose of the wearer.

5. The surgical mask recited in claim 4, in which the said means is in physical contact with the nose-bridge.

6. The surgical mask recited in claim 4, in which the said means is secured to the outside surface of the mask.

7. The surgical mask recited in claim 4, in which said means comprises a strip of shape-retaining material pivotally secured at one of it's ends to the mask.

8. The surgical mask recited in claim 4, wherein the spectacle support means includes a mounting strip of pliable material attached to the mask and having spectacle engaging means integral with and extending laterally from one edge of the strip.

* * * * *